US007150422B2

(12) United States Patent
Wang

(10) Patent No.: US 7,150,422 B2
(45) Date of Patent: Dec. 19, 2006

(54) PAPER SHREDDER HAVING A MANUAL PAPER PRESSING DEVICE

(75) Inventor: Tie-Chun Wang, SanChung (TW)

(73) Assignee: Michilin Prosperity Co., Ltd., Taiei Hsien (TW)

( * ) Notice: Subject to any disclaimer, the term of this patent is extended or adjusted under 35 U.S.C. 154(b) by 109 days.

(21) Appl. No.: 11/037,235

(22) Filed: Jan. 19, 2005

(65) Prior Publication Data

US 2006/0157600 A1 Jul. 20, 2006

(51) Int. Cl.
*B02C 18/22* (2006.01)

(52) U.S. Cl. ..... 241/100; 100/94; 100/97; 241/101.2; 241/236

(58) Field of Classification Search ..... 100/94, 100/97; 241/100, 101.2, 236
See application file for complete search history.

(56) References Cited

U.S. PATENT DOCUMENTS 3,754,498 A * 8/1973 Gil ..... 100/353
5,044,270 A * 9/1991 Schwelling ..... 100/353

FOREIGN PATENT DOCUMENTS

DE 2214786 * 9/1973
JP 11-156222 * 6/1999

* cited by examiner

*Primary Examiner*—Mark Rosenbaum
(74) *Attorney, Agent, or Firm*—Lowe Hauptman & Berner, LLP

(57) ABSTRACT

This invention discloses a paper shredder having a manual paper pressing device, where the paper shredder is provided at a rear end thereof with an aperture, including: a large-size presser disposed beneath the paper shredder and having a connecting shaft at an end thereof, the connecting shaft passing through the aperture provided at the rear end of the paper shredder to movably pivot to a presser rod, the presser rod being rotatable about the pivoting location, wherein when the presser rod is levered upwards from a horizontal position about the pivoting location to a vertical position and then pressed downwards, the large-size presser is activated to compact the paper chips in the basket or bin directly so as to reduce space occupied by the paper chips and to increase capacity of the basket or bin. After the force for causing the presser rod downwards vanishes, the presser rod would recover to its original position due to recovering force exerted by a spring. The user may then lever the presser rod about the pivoting location towards the side so as to store the presser rod at its horizontal position.

4 Claims, 3 Drawing Sheets

PAPER SHREDDER HAVING A MANUAL PAPER PRESSING DEVICE

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of Invention

This invention relates to a paper shredder, particularly to a paper shredder having a manual paper pressing device, where the pressure can be manually operated by a manual paper pressing device so as to compact the paper chips and to increase the capacity of the basket or bin significantly when the user sees that the basket or bin is almost filled up.

2. Background

It is widely known that paper shredders for shredding incorporate plural cutting blades and spacers passing through rotary shafts that are driven to rotate towards each other by a motor and gear box so as to shred paper passing through the rotary shafts into strips by shear forces. Shredders can be classed into two types, the stripe-cut shredders and crosscut shredders, according to the machine cutting style. The former shredders arrange cutting blades to the rotating cutter shafts in a manner for cutting the paper in a longitudinal direction to form strips. The later shredders include blades that include more than one cutting edge part, and each cutter is disposed helically along the rotary cutter shaft for first cutting paper along a horizontal direction into strips and then cutting paper along a longitudinal direction into paper chips of 4 mm by 40 mm.

Regardless of being stripe-cut or crosscut shredders, a basket or bin commonly accompanies the shredders at sales. Upon filling of the basket or bin, the user needs to empty the paper chips in the basket or bin to prevent the paper chips from entering the gaps between the cutting blades or obstructing normal operation of the paper shredders. Experiences show that, the fragmented paper strips or paper chips can easily and freely fall into the basket or bin through the paper drop opening of the paper shredders. Since the light weighted paper strips or paper chips are accumulated in a random manner, the spaces between the paper strips or paper chips are relatively large so as to easily fill up the basket or bin as viewed by the user. However, as stated above, since the light weighted paper strips or paper chips are accumulated in a random manner, the spaces between the paper strips or paper chips are relatively large, when the user removes the paper shredders from the basket or bin and then manually presses the paper strips or paper chips in the basket or bin, the user will realize that the seemingly filled basket or bin, in fact, as more than half of empty space after pressing. Thus, if the paper shredders are provided with a paper pressing device operating like manual pressing, the capacity of the basket or bin can be increased significantly, so as to reduce the frequency of emptying the basket or bin.

SUMMARY OF INVENTION

It is a primary object of this invention to provide a paper shredder having a manual paper pressing device, where the pressure can be manually operated by a manual paper pressing device so as to compact the paper chips and to increase the capacity of the basket or bin significantly when the user sees that the basket or bin is almost filled up.

To achieve the above object, this invention provides a paper shredder having a manual paper pressing device, where the paper shredder is provided at a rear end thereof with an aperture, including: a large-size presser disposed beneath the paper shredder and having a connecting shaft at an end thereof, the connecting shaft passing through the aperture provided at the rear end of the paper shredder to movably pivot to a presser rod, the presser rod being rotatable about the pivoting location, wherein when the presser rod is levered upwards from a horizontal position about the pivoting location to a vertical position and then pressed downwards, the large-size presser is activated to compact the paper chips in the basket or bin directly so as to reduce space occupied by the paper chips and to increase capacity of the basket or bin. After the force for causing the presser rod downwards vanishes, the presser rod would recover to its original position due to recovering force exerted by a spring. The user may then lever the presser rod about the pivoting location towards the side so as to store the presser rod at its horizontal position.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION (PREFERRED EMBODIMENTS)

Figure 1:
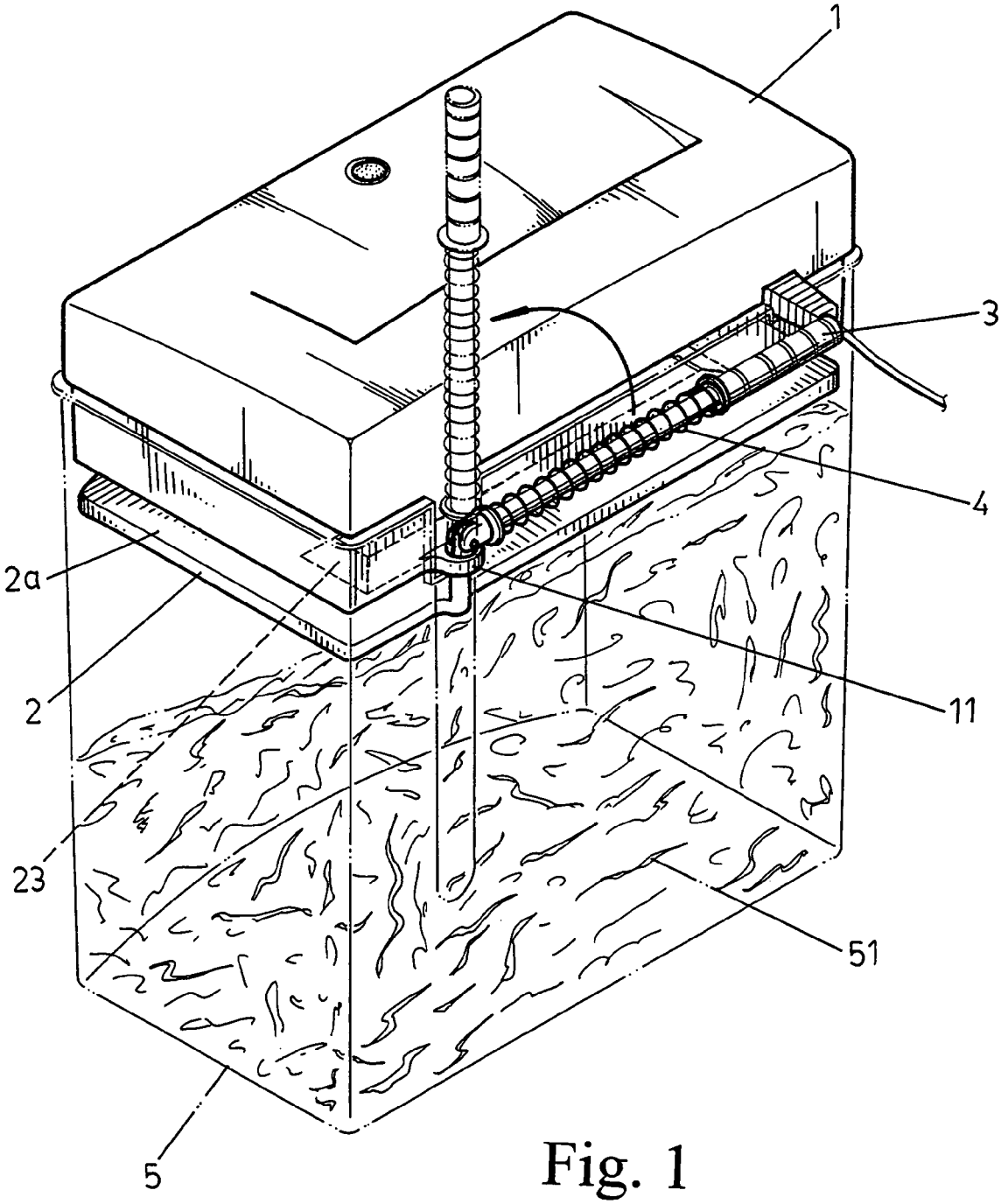
FIG. 1 is a perspective view illustrating the manual paper pressing device of this invention prior to operation.
Figure 2:
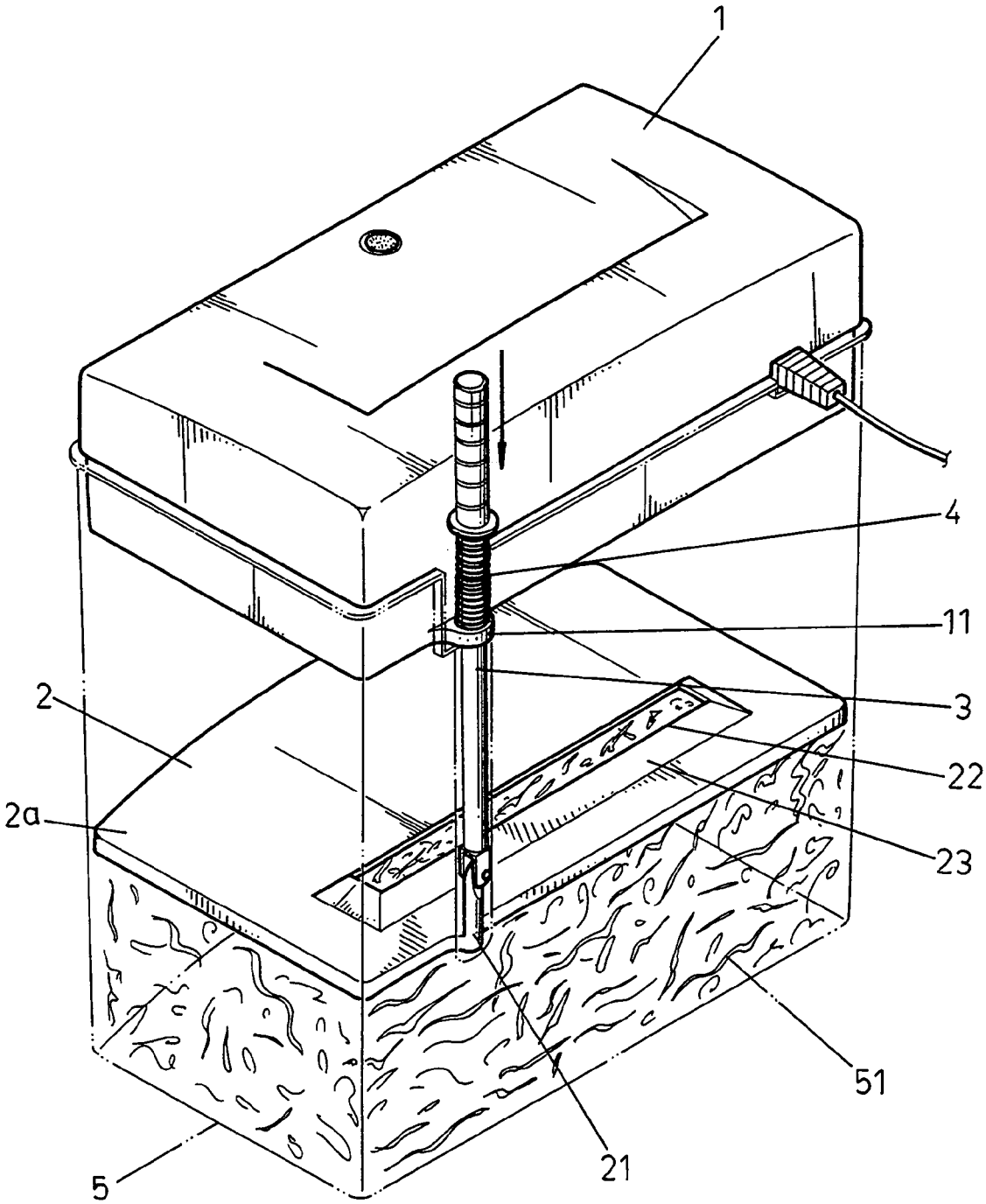
FIG. 2 is a perspective view illustrating the manual paper pressing device of this invention during operation.
Figure 3:
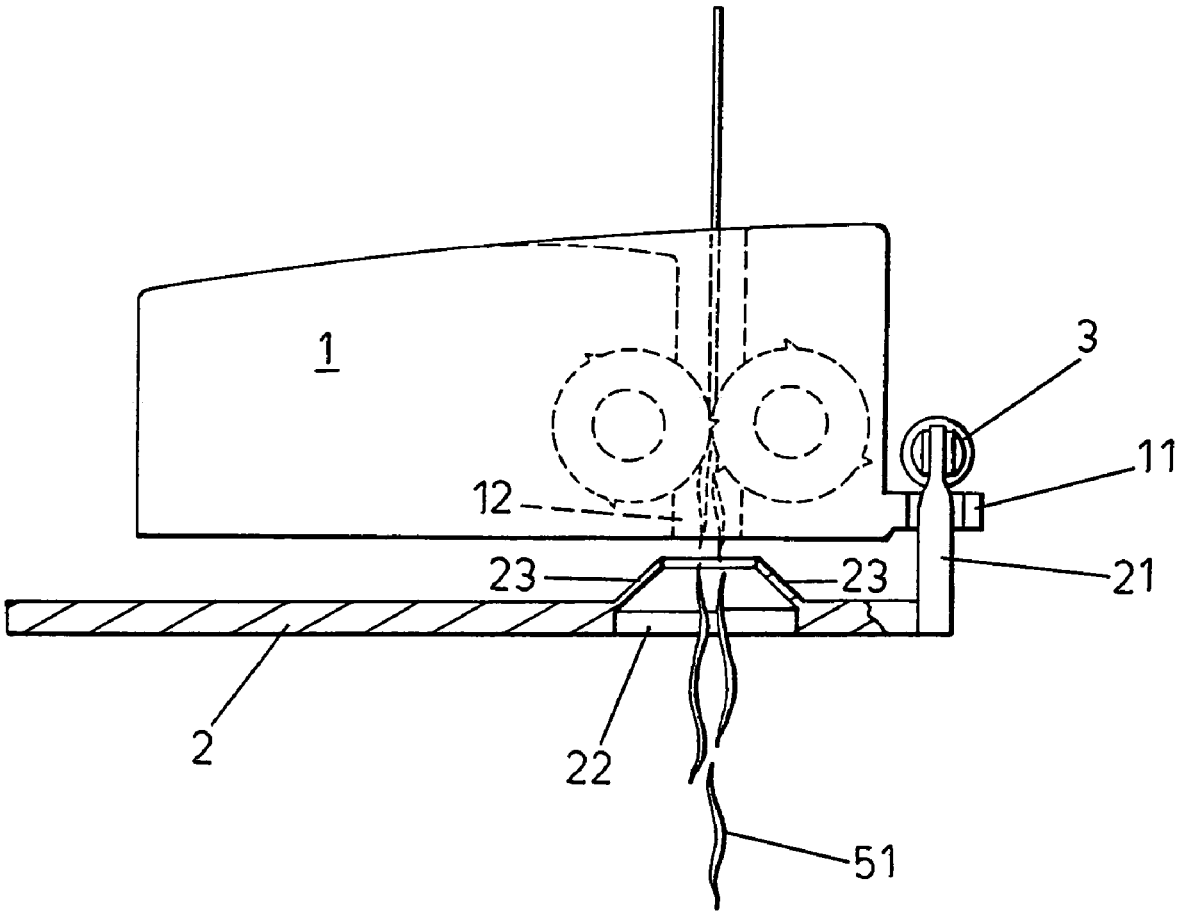
FIG. 3 is a cross-sectional view illustrating the manual paper pressing device of this invention during operation.

With reference to FIGS. 1–3, where FIG. 1 is a perspective view illustrating the manual paper pressing device of this invention prior to operation, FIG. 2 is a perspective view illustrating the manual paper pressing device of this invention during operation, and FIG. 3 is a cross-sectional view illustrating the manual paper pressing device of this invention during operation.

As shown, the paper shredder 1 is provided at a rear end thereof with an aperture 11. A large-size presser 2 is disposed beneath the paper shredder 1 and includes a connecting shaft 21 at an end thereof. The connecting shaft 21 passes through the aperture 11 provided at the rear end of the paper shredder 1 to movably pivot to a presser rod 3 provided with a spring 4. The presser rod 3 is rotatable about the pivoting location. When the presser rod 3 is levered upwards from a horizontal position (shown by the solid lines in FIG. 1) about the pivoting location to a vertical position (shown by the broken lines in FIG. 1) and then pressed downwards, the large-size presser 2 is activated to compact the paper chips 51 in the basket or bin 5 directly so as to reduce space occupied by the paper chips 51 and to increase capacity of the basket or bin 5. After the force for causing the presser rod 3 downwards vanishes, the presser rod 3 would recover to its original position due to recovering force exerted by the spring 4. The user may then lever the presser rod 3 about the pivoting location towards the side so as to store the presser rod 3 at its horizontal position.

A hole 22 is formed to the large-size presser 2 at a location corresponding to the paper drop opening 12 of the paper shredder 1, through which hole 22 paper chips of the paper shredder 1 may drop. A guide plate 23 is formed at the perimeter of the hole 22, inclining towards the paper drop opening 12 of the paper shredder 1 so as to prevent the paper chips 51 from entering space above the large-size presser 2*a* when the large-size presser 2 compacts the paper chips 51 downwards.

In addition, to reduce the overall cost by reducing the number of components, the spring for recovering the presser rod to its original position may be eliminated. In this case, the user may manually lift the presser rod upwards to substitute for the upward force exerted by the spring.

As is understood by a person skilled in the art, the foregoing preferred embodiment of the present invention is illustration of the present invention rather than limiting of the present invention. It is intended that various modifications and similar arrangements be included within the spirit and scope of the appended claims, the scope of which should be accorded the broadest interpretation so as to encompass all such modifications and similar structure.

LIST OF REFERENCE NUMERALS

1 paper shredder
11 aperture
12 paper drop opening
2 large-size presser
2*a* space above large-size presser
21 connecting shaft
22 hole
23 guide plate
3 presser rod
4 spring
5 basket or bin
51 paper chips

What is claimed is:

1. A paper shredder having a manual paper pressing device, where the paper shredder is provided at a rear end thereof with an aperture, including: a large-size presser disposed beneath the paper shredder and having a connecting shaft at an end thereof, the connecting shaft passing through the aperture provided at the rear end of the paper shredder to movably pivot to a presser rod, the presser rod being rotatable about the pivoting location, wherein when the presser rod is levered upwards from a horizontal position about the pivoting location to a vertical position and then pressed downwards, the large-size presser is activated to compact the paper chips in the basket or bin directly so as to reduce space occupied by the paper chips and to increase capacity of the basket or bin.

2. The paper shredder having a manual paper pressing device of claim 1, wherein the large-size presser is formed with a hole at a location corresponding to a paper drop opening of the paper shredder.

3. The paper shredder having a manual paper pressing device of claim 2, wherein the large-size presser is provided with a guide plate inclining towards the paper drop opening of the paper shredder at a location corresponding to a perimeter of the hole provided to the paper drop opening of the paper shredder.

4. The paper shredder having a manual paper pressing device of claim 1, wherein the presser rod is provided thereto with a spring.

* * * * *